US007439673B2

(12) United States Patent
Dagois et al.

(10) Patent No.: US 7,439,673 B2
(45) Date of Patent: Oct. 21, 2008

(54) IMAGE DISPLAY PANEL HAVING A MATRIX OF ELECTROLUMINESCENT CELLS WITH SHUNTED MEMORY EFFECT

(75) Inventors: Jean-Paul Dagois, Cesson Sevigne (FR); Christophe Fery, Rennes (FR)

(73) Assignee: Thomson Licensing, Boulogne Billancourt (FR)

( * ) Notice: Subject to any disclaimer, the term of this patent is extended or adjusted under 35 U.S.C. 154(b) by 442 days.

(21) Appl. No.: 10/499,600

(22) PCT Filed: Dec. 12, 2002

(86) PCT No.: PCT/FR02/04314

§ 371 (c)(1),
(2), (4) Date: Jan. 11, 2005

(87) PCT Pub. No.: WO03/054843

PCT Pub. Date: Jul. 3, 2003

(65) Prior Publication Data

US 2005/0116618 A1 Jun. 2, 2005

(30) Foreign Application Priority Data

Dec. 18, 2001 (FR) ..... 01 16843

(51) Int. Cl.
*H01J 1/62* (2006.01)
*H01J 63/04* (2006.01)

(52) U.S. Cl. ..... 313/507; 313/501; 313/506

(58) Field of Classification Search ..... 313/495–512
See application file for complete search history.

(56) References Cited

U.S. PATENT DOCUMENTS

| | | | | |
|---|---|---|---|---|
| 2,874,308 | A * | 2/1959 | Livingston | 250/214 LA |
| 3,070,701 | A * | 12/1962 | Wasserman | 250/208.3 |
| 3,786,307 | A | 1/1974 | Robinson | |
| 4,035,774 | A | 7/1977 | Chang | |
| 6,188,175 | B1 * | 2/2001 | May et al. | 313/504 |
| 2004/0233138 | A1 * | 11/2004 | Haas et al. | 345/76 |

FOREIGN PATENT DOCUMENTS

GB 889277 1/1962

OTHER PUBLICATIONS

E. E. Debar et al. "Erasable Memory Storage Display", IBM Technical Disclosure Bulletin, vol. 24, No. 5, Oct. 1981, pp. 2307-2310.
Search Report dated Feb. 4, 2004.

* cited by examiner

*Primary Examiner*—Toan Ton
*Assistant Examiner*—Bumsuk Won
(74) *Attorney, Agent, or Firm*—Joseph J. Laks; Harvey D. Fried; Patricia Verlangieri

(57) ABSTRACT

An image display panel formed from a matrix of electroluminescent cells is described. The display panel has a front array of electrodes and a rear array of electrodes, an electroluminescent element, a photoconductive element and an element that provides optical coupling between the electroluminescent element and the photoconductive element. The electroluminescent element includes at least one electroluminescent layer and the photoconductive element includes at least one photoconductive layer. A shunt element connects at least one electroluminescent element in parallel to an electrode of the front array.

9 Claims, 8 Drawing Sheets

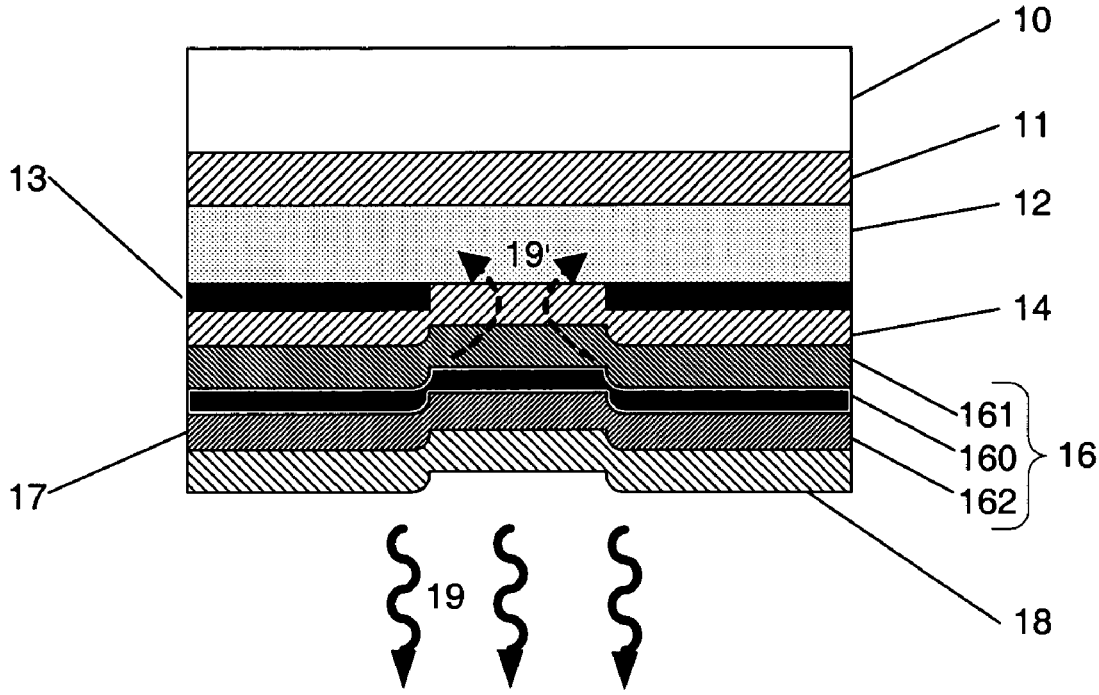
FIG. 1 – PRIOR ART
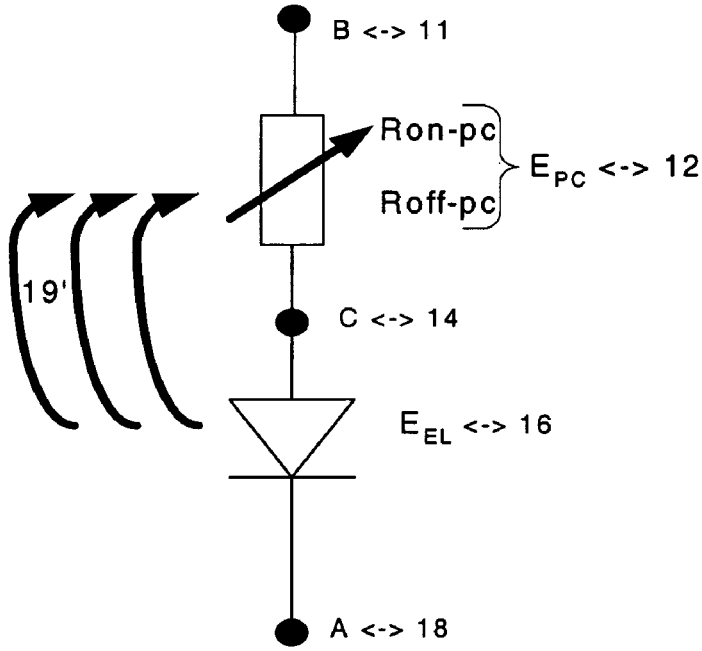
FIG. 2 – PRIOR ART

IMAGE DISPLAY PANEL HAVING A MATRIX OF ELECTROLUMINESCENT CELLS WITH SHUNTED MEMORY EFFECT

This application claims the benefit, under 35 U.S.C. § 365 of International Application PCT/FR02/04314, filed Dec. 12, 2002, which was published in accordance with PCT Article 21(2) on Jul. 3, 2003 in French and which claims the benefit of French patent application No. 0116843, filed Dec. 18, 2001.

The invention relates to an image display panel formed from a matrix of electroluminescent cells, comprising, with reference to FIG. 1:

an electroluminescent layer 16 that can emit light toward the front of said panel (light emission arrows 19);

at the front of this layer, a transparent front electrode layer 18;

at the rear of this layer, a photoconductive layer 12, which itself is inserted between an opaque rear electrode layer 11 and an intermediate electrode layer 14 in contact with the electroluminescent layer 16; and means for optical coupling between said electroluminescent layer 16 and said photoconductive layer 12, which means may, for example, be formed by a specific coupling layer 13 (as in the figure) or formed in the intermediate electrode layer 14.

Panels of this type also include a substrate 10, at the rear (as in the figure) or at the front of the panel, for supporting the combination of layers described above; this is in general a glass plate or a sheet of polymer material.

The photoconductive layer 12 is designed to provide the cells of the panel with a memory effect that will be described later.

The electrodes of the front layer 18, of the rear layer 11 and of the intermediate layer 14 are designed, in a manner known per se, to be able to control and maintain the emission of the cells of the panel, independently of one another; for this purpose, the electrodes of the front layer 18 are, for example, arranged in rows Y and the electrodes of the rear layer 11 are therefore arranged in columns X, these generally being orthogonal to the rows; the electrodes may also have the reverse configuration, namely front layer electrodes in columns and rear layer electrodes in rows; the cells of the panel are located at the intersections of the row electrodes Y and column electrodes X, and they are therefore arranged in a matrix.

To display images on such a panel that are partitioned into an array of light spots, the electrodes of the various layers are supplied so as to make an electrical current flow through the cells of the panel corresponding to the light spots of said image; the electrical current that flows between an X electrode and a Y electrode, in order to supply a cell positioned at the intersection of these electrodes, passes through the electroluminescent layer 16 located at this intersection; the cell thus excited by this current then emits light 19 toward the front face of the panel; the light emitted by all the excited cells of the panel forms the image to be displayed.

Documents U.S. Pat. No. 4,035,774 (IBM), U.S. Pat No. 4,808,880 (CENT) and U.S. Pat. No. 6,188,175 B1 (CDT) disclose panels of this type.

The electroluminescent layer 16, when it is organic, is generally made up of three sublayers, namely an electroluminescent central sublayer 160 sandwiched between a hole transport sublayer 162 and an electron transport sublayer 161.

The electrodes of the front electrode layer 18, in contact with the hole transport sublayer 162, therefore serve as anodes; this electrode layer 18 must be at least partly transparent in order to let the light emitted by the electroluminescent layer 16 pass through it toward the front of the panel; the electrodes of this layer are generally themselves transparent and made of a mixed indium tin oxide (ITO) or made of a conductive polymer such as polyethylene dioxythiophene (PDOT).

The intermediate electrode layer 14 must be sufficiently transparent to allow suitable optical coupling between the electroluminescent layer 16 and the photoconductive layer 12, as this optical coupling is necessary for the operation of the panel and, in particular, for obtaining the memory effect described below.

The above mentioned documents also disclose configurations in which, contrarily to what has been described, on the one hand, the electrodes of the intermediate electrode layer 14 and the sublayer 161 serve respectively for the injection and for the transport of holes in the electroluminescent sublayer 160 and, on the other hand, the electrodes of the front electrode layer 18 and the sublayer 162 serve respectively for the injection and for the transport of electrons in the electroluminescent sublayer 160.

According to another embodiment, the front electrode layer 18 may itself comprise several sublayers, including a sublayer for interfacing with the organic electroluminescent layer 16 intended to improve hole injection (in the anode case) or electron injection (in the cathode case).

The photoconductive layer 16 may, for example, be made of amorphous silicon or of cadmium sulfide.

In the display panels of this type, the role of the photoconductive layer 12 is to provide the cells of the panel with a "memory" effect; referring to FIG. 2, each cell of the panel may be represented by two elements in series:

an electroluminescent element $E_{EL}$ encompassing an electroluminescent layer region 16; and a photoconductive element $E_{PC}$ encompassing a photoconductive layer region 12 facing this same electroluminescent layer region 16.

The memory effect that is obtained relies on a loop operation, as shown in FIG. 2: as long as an electroluminescent element $E_{EL}$ of a cell emits light 19, a part 19' of which reaches, by optical coupling, the photoconductive element $E_{PC}$ of this same cell, the switch formed by this element $E_{PC}$ is closed, and as long as this switch is closed, the electroluminescent element $E_{EL}$ Is supplied with current between a terminal A in contact with one electrode of the front layer 18 and a terminal B in contact with one electrode of the rear layer 11; the electroluminescent element $E_{EL}$ therefore emits light 19, a part 19' of which excites the photoconductive element $E_{PC}$.

This loop operation therefore relies on suitable optical coupling between the electroluminescent layer 16 and the photoconductive layer 12; if the display panel includes a specific optical coupling layer, this may, for example, be an opaque insulating layer pierced by suitable transparent apertures positioned facing each electroluminescent element $E_{EL}$, that is to say each pixel or sub pixel of the panel; in the absence of a specific coupling layer, it is also possible to use, as coupling means, transparent apertures made in the intermediate electrode layer 14; other optical coupling means are conceivable, these being known to those skilled in the art but they will not be described here in detail.

This supposed memory effect is intended to make it easier to control the pixels and sub pixels of the panel in order to display images and, in particular, to make it possible to use a procedure in which, successively for each row of the panel, an address phase, designed to turn on the cells to be turned on in this row, is followed by a sustain phase, designed to keep the cells of this row in the state in which they had been put or left during the preceding address phase.

In practice, each row of the panel is scanned in succession in order to bring each cell of the scanned row into the desired,—on or off—state; after a given row has been scanned, all the cells of this row are maintained or supplied in the same manner so that only the cells turned on in this row emit light during the scan or while other rows are being addressed; thus, while a row is in the sustain phase, it is preferred to carry out the address phases for other rows.

In practice, the duration of the sustain phases makes it possible to modulate the luminance of the cells of the panel and, in particular, to generate the gray levels needed for displaying an image.

The implementation of such a procedure for driving the cells of the panel generally comprises:

during the address phases, the application of an ignition voltage $V_a$ only to the terminals A, B of the cells to be turned on; and during the sustain phases, the application of a sustain voltage $V_S$ to the terminals A, B of all the cells, which voltage must be high enough for the cells turned on beforehand to remain turned on and low enough not to risk turning on the cells that were not turned on beforehand.

The address phase is therefore a selective phase; in contrast the sustain phase is not selective, thereby making it possible to apply the same voltage to all the cells and considerably simplifying the way in which the panel is driven.

Document IBM Technical Disclosure Bulletin, Vol. 24, No. 5, pp 2307-2310, entitled "*Erasable memory storage display*", describes a display panel in which each cell comprises:

an inorganic electroluminescent element Zel and a photoconductive element LPC that are connected in series as in the display panels of the aforementioned type; and furthermore, a photoconductive erase element, reference EPC in that document, connected in parallel to said electroluminescent element.

The photoconductive erase element in parallel with the electroluminescent element has a resistance that varies between a low value R-ON when it is excited by an erase illumination and a low value R-OFF when it is not illuminated; according to that document, this photoconductive erase element serves for turning off the corresponding cells that were on and in sustain phase; the procedure for driving the panel therefore includes phases for erasing the cells, during which these cells are illuminated by an erase illumination.

During an erase phase, which generally terminates a sustain phase, it is of course necessary that, in each cell that is in the ON state, which is to be erased, and the photoconductive erase element of which is excited, the resistance R-ON is less than the resistance $R_{ON\text{-}EL}$ that the electroluminescent element $E_{EL}$ has in the on state so that it is possible to consider that the intensity of the electrical current passing through this cell still in the ON state passes essentially through the photoconductive erase element and not through the electroluminescent element $E_{EL}$, since said cell is specifically to be turned off.

Outside the erase phases, the photoconductive erase elements have a resistance R-OFF and the electroluminescent elements $E_{EL}$ of the panel are either in the off state, and have a resistance $R_{OFF\text{-}EL}$, or in the on state, and have a resistance $R_{ON\text{-}EL}$; nothing is mentioned in that document about the value of R-OFF compared with the value of $R_{OFF\text{-}EL}$, so that a person skilled in the art can draw no teaching as regards the effective and efficient shunt function that the photoconductive erase elements would or would not have in the unexcited state in relation to the electroluminescent elements in the off state.

Thus, that document is limited to describing means capable of effectively shunting electroluminescent elements in the on state, in order to erase them, whereas the invention, as will be seen later, proposes, for an entirely different purpose, means for shunting the electroluminescent elements in the off state.

The memory effect will now be described in more detail when a drive procedure of this type is applied to an electroluminescent panel with memory effect of the type that has just been described, in the case in which the regions of the intermediate electrode layer 14 specific to each electroluminescent element $E_{EL}$ are electrically isolated from one another, so that the electrical potential at the common point C of the electroluminescent element $E_{EL}$ and of the photoconductive element $E_{PC}$ is floating.

Again with reference to FIG. 2, the display panel forms a set of cells $C_{n,p}$ that can emit light and are supplied via rows of electrodes $Y_n$, $Y_{n+1}$ of the front layer 18 that are connected to points A corresponding to a terminal of an electroluminescent element $E_{EL}$ and via columns of electrodes $X_p$, $X_{p+1}$ of the rear layer 11 that are connected to points B corresponding to a terminal of a photoconductive element $E_{PC}$.

FIG. 3 illustrates, according to this conventional drive mode:

for a cell $C_{n,p}$, an address sequence for this row at time $t_1$, with ignition of this cell, which remains on for $t>t_1$, for a cell of the next row $C_{n+1,p}$, an address sequence for this row at time $t_2$, with no ignition of this cell, which remains off for $t>t_2$.

The three timing diagrams $Y_n$, $Y_{n+1}$, $X_p$ indicate the voltages applied to the row electrodes $Y_n$, $Y_{n+1}$ and to the column electrode $X_p$ in order to obtain these sequences.

The bottom of FIG. 3 indicates the values of the potentials at the terminals A, B (FIG. 2) of the cells $C_{n,p}$, $C_{n+1,p}$ and the state—ON or OFF—of these cells.

To obtain the ON or OFF state indicated at the bottom of this figure, it is therefore necessary, when applying to the terminals A, B of a cell as shown in FIG. 2:

a potential $V_a$ to a cell in the OFF state, for this cell to switch to the ON state;

a potential $V_S$ or $(V_S-V_{off})$ to a cell in the ON state, for this cell to remain in the ON state; and a potential $(V_a-V_{off})$ or $V_S$ to a cell in the OFF state, for this cell to remain in the OFF state.

These various potential values are repeated in FIG. 4 by placing them with respect to:

the threshold voltage $V_{s.EL}$ across the terminals A, C of the light-emitting diode $E_{EL}$ of the cell (FIG. 2), below which voltage this diode is off and above which it is on; the typical characteristic of such a diode $E_{EL}$ is shown in FIG. 5 (emitted light intensity in lumens plotted as a function of the applied voltage in volts); and the voltage $V_T$ across the terminals A, B of a cell, above which a cell in the OFF state is ignited and passes to the ON state.

To obtain the desired memory effect, the value of the voltage $V_{off}$ that can be applied to the column electrodes like $X_p$ must be chosen so that the voltage $V_a-V_{off}$ applied across the terminals of a cell is insufficient to turn it on, hence $V_a-V_{off}<V_T$ and so that the voltage $V_s-V_{off}$ does not affect the on or off state of the cell, hence $V_{S.EL}<V_s-V_{off}$.

As illustrated in FIG. 4, in order for the panel to operate properly, it is therefore necessary for a cell $C_{n,p}$ to which a voltage $Va>V_T$, has been applied to continue to emit a significant amount of light even if the voltage applied across its terminals decreases down to the value $V_s - V_{off}$ which remains above $V_{S,EL}$; for this type of operation, it is necessary for the cell, that is to say the electroluminescent element $E_{EL}$ and the photoconductive element $E_{PC}$ that are connected in series, to exhibit substantial hysteresis.

The typical characteristic of a photoconductive element $E_{PC}$ of a cell $C_{n,p}$ of the panel is shown in FIG. 6 (electrical current in amps as a function of illumination in lumens, when this element $E_{PC}$ is subjected to a voltage of 10 V); taking into account the already mentioned characteristics (FIG. 5) of the electroluminescent element $E_{EL}$, it is now possible to represent the overall current-voltage characteristics of both these elements $E_{EL}$ and $E_{PC}$ in series forming a cell $C_{n,p}$ of the panel: see FIG. 7, which illustrates, when a voltage increasing from 0 to 20 V and then decreasing from 20 to 0 V is applied across the terminals A, B of a cell:

the voltage $V_{E\text{-}el}$ at the terminals A, C of the electroluminescent element of the cell;

the voltage $V_{E\text{-}pc}$ of the terminals C, B of the photoconductive element of the cell; and the intensity I of the current flowing in this cell.

It will be seen that, during one cycle, in which the voltage increases up to ignition (high intensity) and then decreases down to extinction, the variation in the intensity I of the current in this cell exhibits no hysteresis, which demonstrates that there exists in fact no sustain region (see FIG. 4) of voltage values in which the cell, having been turned on beforehand, remains on; the memory effect described above is therefore not obtained.

The object of the invention is to overcome the lack or insufficiency of memory effect.

For this purpose, the subject of the invention is an image display panel comprising a matrix of electroluminescent cells with memory effect that are capable of emitting light toward the front of said panel, comprising:

a front array of electrodes and a rear array of electrodes, the electrodes of the front array crossing the electrodes of the rear array at each of said cells, at least one electroluminescent layer forming, for each cell, at least one electroluminescent element, a photoconductive layer for obtaining said memory effect, forming, for each cell, a photoconductive element, at least one electroluminescent element and the photoconductive element of each cell being electrically connected in series and the two outermost terminals of said series being connected, in the case of one of them to an electrode of said front array and in the case of the other to an electrode of said rear array, means for optical coupling, at each cell, between at least one electroluminescent layer of the panel and said photoconductive layer, characterized in that it comprises, for each cell, a shunt element placed in parallel with at least one electroluminescent element of said cell and the resistance of which does not depend on the illumination.

Since the resistance of the shunt elements does not depend on the illumination, the use as shunts of photoconductive erase elements such as those described in the document IBM Technical Disclosure Bulletin, Vol. 24, No. 5, pp. 2307-2310 mentioned above is completely excluded; the term "shunt element" is therefore intended here to mean a conventional resistor produced using a non-photoconductive material and having a resistance that does not vary appreciably with illumination.

Preferably, the electroluminescent layer or layers of the panel are organic.

The invention also applies to panels of the same type as those disclosed in the above mentioned document U.S. Pat No. 4,035,774 (IBM) which include a rear electroluminescent layer for emitting light suitable for activating or exciting the photoconductive cells and a front electroluminescent layer for emitting the light needed to display the images; the photoconductive layer is sandwiched between the two electroluminescent layers and is optically coupled only, or mainly, with the rear electroluminescent layer; each cell comprises here two electroluminescent elements, one at the rear and the other at the front, and a sandwiched photoconductive element; the outermost terminals of the series formed by these three elements are connected in the case of one of them to a rear electrode and in the case of the other to a front electrode.

In the usual situation in which the panel comprises only a single organic electroluminescent layer, the subject of the invention is an image display panel comprising a matrix of electroluminescent cells with memory effect that are capable of emitting light toward the front of said panel, comprising:

a front array of electrodes and a rear array of electrodes, the electrodes of the front array crossing the electrodes of the rear array at each of said cells, an electroluminescent organic layer forming, for each cell, an electroluminescent element one terminal of which is connected to an electrode of said front array, a photoconductive layer for obtaining said memory effect, forming, for each cell, a photoconductive element, one terminal of which is connected to an electrode of said rear array, means for electrically connecting to the same potential, at each cell, the other terminal of the electroluminescent element and the other terminal of the photoconductive element and means for optical coupling between said electroluminescent element of each cell and said photoconductive element of this same cell, characterized in that it comprises, for each cell, a shunt element placed in parallel with the electroluminescent element of said cell and the resistance of which does not depend on the illumination.

In this most frequent embodiment of the invention, the equivalent circuit diagram of any cell of the panel is shown in FIG. 9; the references $E_{PC}$, $E_{EL}$ refer respectively to the photoconductive element and to the electroluminescent element of this cell, as in FIG. 2 described above; according to the invention, this cell furthermore includes a shunt element $E_{S.EL}$ of resistance $R_{S.EL}$ which is constant and independent of the illumination, said shunt element being connected in parallel with the electroluminescent element $E_{EL}$.

We will now determine what resistance has to be given to the resistor $R_{S.EL}$ of the shunt element $E_{S.EL}$ in order to best take advantage of the invention.

Firstly, it is necessary of course for the resistance $R_{S.EL}$ to be greater than the resistance $R_{ON\text{-}EL}$ that the electroluminescent element $E_{EL}$ has in the on state, so that it is possible to consider that, when the cell is in the ON state, the intensity of the electrical current flowing through it passes essentially via the electroluminescent element $E_{EL}$; preferably therefore, $R_{S.EL} > R_{ON\text{-}EL}$; thus, the ohmic losses in the shunt element when the cells are on are limited; in order for the losses to be even further limited, it is preferable that $R_{S.EL} > 2 \times R_{ON\text{-}EL}$.

It should be noted that this feature makes an even greater distinction between the shunt element according to the invention and the photoconductive erase element of the panel described in the aforementioned document IBM Technical Disclosure Bulletin, Vol. 24, No 5, pp. 2307-2310; this is because, since the resistance $R_{S.EL}$ of this shunt element is greater than the internal resistance $R_{ON-EL}$ that the electroluminescent element $E_{EL}$ has in the on state, it is in no case capable of effectively shunting the corresponding electroluminescent element $E_{EL}$ when it is on; in contrast, it should be noted that the shunt element according to the invention would turn off or erase the corresponding electroluminescent element, which would absolutely be counter to the objective of the invention.

In short, the above mentioned document IBM Technical Disclosure Bulletin, Vol. 24, No. 5, pp. 2307-2310 discloses means for shunting the electroluminescent elements in the on state, whereas the invention proposes means for shunting the electroluminescent elements in the off state.

Secondly, the resistance $R_{S.EL}$ must be less, preferably very much less, than the internal resistance $R_{OFF-EL}$ that the electroluminescent element $E_{EL}$ has in the off state so that it is possible to consider that, when the cell is in the OFF state, the intensity of the electrical current flowing through it passes essentially via the shunt element $E_{S.EL}$; therefore $R_{S.EL}<R_{OFF-EL}$, preferably $R_{S.EL}<\frac{1}{2} R_{OFF-EL}$; in other words, the shunt element according to the invention is "conducting" when the electroluminescent element $E_{EL}$ is in the off state, whereas the photoconductive erase element disclosed in the aforementioned document IBM Technical Disclosure Bulletin is designed to be able to become "conducting" when the electroluminescent element $E_{EL}$ is in the on state.

In general, it should be noted that $R_{OFF-EL}>R_{ON-EL}$, which advantageously makes it possible to combine the two conditions mentioned above, namely $R_{S.EL}>R_{ON-EL}$ and $R_{S.EL}<R_{OFF-EL}$.

Let $R_{OFF-PC}$ be the resistance of the photoconductive element $E_{PC}$ in the unexcited or OFF state; under the panel drive conditions described above with reference to FIGS. 3 and 4, according to the definition given above, let $V_T$ be the voltage across the terminals A, B of this cell, above which voltage this extinguished cell (in the OFF state) is ignited and switches to the ON state; then, for a voltage $V_T-\epsilon$ very slightly less than the ignition voltage $V_T$ ($\epsilon$ very small), the voltage $V_{E-el}$ across the terminals of the electroluminescent element $E_{EL}$ is very close to the threshold voltage $V_{S.EL}$, defined above, so that: $V_{E-el}=V_{S.EL}-\epsilon'$ ($\epsilon'$ very small); if $V_{PC}$ is the voltage across the terminals of the photoconductive element $E_{PC}$, then $V_T-\epsilon=V_{PC}+V_{S.EL}-\epsilon'$; moreover, if I is the intensity of the current flowing through the cell and if it is considered that all this current passes through the shunt element $E_{S.EL}$ and not through the electroluminescent element $E_{EL}$, because the cell is extinguished, then:

$$V_T-\epsilon=V_{PC}+V_{S.EL}-\epsilon'=(R_{OFF-PC}+R_{S.EL})\times I$$

$$V_{E-el}=V_{S.EL}-\epsilon'=R_{S.EL}\times I$$

From these two equations, it may be deduced that: $V_T-\epsilon=(1+R_{OFF}/R_{S.EL})(V_{S.EL}-\epsilon')$, i.e., by simplification: $V_T=(1+R_{OFF-PC}/R_{S.EL})V_{S.EL}$ or $(V_T/V_{S.EL})=(1+R_{OFF-PC}/R_{S.EL})$.

On examining the diagram of the panel drive voltages shown in FIG. 4, the width of the "sustain region" corresponds to $V_T-V_{S.EL}$; in practice, to take advantage of a "sustain region" wide enough to be able to easily drive the display panel, it is necessary for the difference $V_T-V_{S.EL}$ to be greater than or equal to 8 or 9 volts; if for example the threshold voltage for tripping the light-emitting diode is $V_{S.EL}=9$ V, it is necessary for $(V_T/V_{S.EL})\geqq 2$, i.e. $(R_{OFF-PC}/R_{S.EL})\geqq 1$ or $R_{S.EL}\leqq R_{OFF-PC}$; for the purpose of limiting the losses, the light-emitting diode technology for displaying images is moving toward the lowering of the trip threshold voltages to below a value of 9 volts, which means that, in order for the width of the "sustain region" to remain greater than 8 or 9 volts, the ratio $(V_T/V_{S.EL})$ is strictly greater than 2, or even equal to or greater than 3, and the ratio $(R_{OFF-PC}/R_{S.EL})$ is strictly greater than $_1$, or even equal to or greater than 2.

Thus, preferably, for each cell of the panel according to the invention, the resistance $R_{S.EL}$ of the shunt element $E_{S.EL}$ of the electroluminescent element $E_{EL}$ of this cell is less than or equal to the resistance $R_{OFF-PC}$ of the corresponding photoconductive element $E_{PC}$ when it is not in the excited state, and is less than the resistance $R_{OFF-EL}$ of the corresponding electroluminescent element $E_{EL}$ when it is off, which in general assumes that $R_{OFF-EL}>R_{OFF-PC}$.

Preferably, the resistance $R_{S.EL}$ of the shunt element $E_{S.EL}$ of the electroluminescent element $E_{EL}$ of this cell is strictly less than the resistance $R_{OFF-PC}$ of the corresponding photoconductive element $E_{PC}$ when it is not in the excited state, or even less than or equal to one half of this resistance.

Thanks to the shunt element $E_{S.EL}$ of the electroluminescent element according to the invention, it has been found, as illustrated in more detail in the example below, that the panel is now provided with a memory effect that can be really exploited by a conventional drive procedure, such as that described above, and that the variation in the intensity I of the current in each cell of the panel exhibits hysteresis and a sustain region (see FIGS. 4 and 10) with voltage values in which, with the cell having been turned on beforehand, the latter remains on.

In another advantageous embodiment of the invention, the panel according to the invention also includes, for each cell, a shunt element placed in parallel with the photoconductive element of said cell.

A substantial reduction in the energy consumption of the panel is thus achieved; furthermore, this additional shunt makes it easier for the photoconductive elements to be de-excited and advantageously makes it possible to reduce the cell switching times of the panel.

The equivalent circuit diagram of any cell of the panel according to this other advantageous embodiment of the invention is shown in FIG. 15; the references $E_{PC}$, $E_{EL}$ relate to the photoconductive element and to the electroluminescent element of this cell, respectively; this cell includes here not only a shunt element $E_{S.EL}$, of resistance $R_{S.EL}$, connected in parallel with the electroluminescent element $E_{EL}$, but also a shunt element $E_{S.PC}$, of resistance $R_{S.PC}$, connected in parallel with the photoconductive element $E_{PC}$.

Let $R_{OFF-PC}$ be the resistance of the photoconductive element $E_{PC}$ in the un-excited or OFF state; the resistance $R_{S.PC}$ must be chosen to be very much less than the internal resistance $R_{OFF-PC}$ that the photoconductive element $E_{PC}$ has in the off state, so that it is possible to consider that, when the cell is in the OFF state, the intensity of the electrical current flowing through it passes entirely via the shunt element $E_{S.PC}$; therefore $R_{S.PC}<R_{OFF-PC}$, preferably $R_{S.PC}<\frac{1}{2} R_{OFF-PC}$.

Under the panel drive conditions (described above with reference to FIGS. 3 and 4), in accordance with the definition already given, let $V_T$ be the voltage across the terminals A, B of this cell, above which voltage this extinguished cell (in the OFF state) is ignited and switches to the ON state; therefore, for a voltage $V_T-\epsilon$ very slightly less than the ignition voltage $V_T$ ($\epsilon$ very small), the voltage $V_{E-el}$ across the terminals of the electroluminescent element $E_{EL}$ is very similar to the previously defined threshold voltage $V_{S.EL}$, so that: $V_{E-el}=V_{S.EL}-\epsilon'$ ($\epsilon'$ very small); if $V_{E-pc}$ is the voltage across the terminals of the photoconductive element $E_{PC}$, then $V_T-\epsilon=V_{E-pc}+V_{S.EL}-\epsilon'$; moreover, if I is the intensity of the current flowing through the cell and if it is considered that all this current passes through the shunt elements $E_{S.PC}$ and $E_{S.EL}$, and not through the photoconductive element $E_{PC}$ and the electroluminescent element $E_{EL}$, because the cell is off, then:

$$V_T-\epsilon=V_{E\text{-}pc}+V_{S.EL}-\epsilon'=(R_{S.PC}+R_{S.EL})\times I$$

$$V_{E\text{-}el}=V_{S.EL}-\epsilon'=R_{S.EL}\times I.$$

From these two equations it may be deduced that: $V_T-\epsilon=(1+R_{S.PC}/R_{S.EL})(V_{S.EL}-\epsilon')$, i.e., by simplification: $V_T=(1+R_{S.PC}/R_{S.EL})V_{S.EL}$ or $(V_T/V_{S.EL})=(1+R_{S.PC}/R_{S.EL})$.

On examining the diagram of the panel drive voltages shown in FIG. 4, the width of the "sustain region" corresponds to $V_T-V_{S.EL}$; in practice, to take advantage of a "sustain region" wide enough to be able to easily drive the display panel, it is necessary for the difference $V_T-V_{S.EL}$ to be greater than or equal to 8 or 9 volts; if for example the threshold voltage for tripping the light-emitting diode is $V_{S.EL}=9$ V, it is necessary for $(V_T/V_{S.EL})\geqq 2$, i.e. $(R_{S\text{-}PC}/R_{S.EL})\geqq 1$ or $R_{S.EL}\leqq R_{S\text{-}PC}$; for the purpose of limiting the losses, the light-emitting diode technology for displaying images is moving toward the lowering of the trip threshold voltages to below a value of 9 volts, which means that, in order for the width of the "sustain region" to remain greater than 8 or 9 volts, the ratio $(V_T/V_{S.EL})$ is strictly greater than 2, or even equal to or greater than 3, and the ratio $(R_{S.PC}/R_{S.EL})$ is strictly greater than 1, or even equal to or greater than 2.

Thus, preferably, for each cell of the panel according to the invention, the resistance $R_{S.PC}$ of the shunt element $E_{S.PC}$ of the photoconductive element $E_{PC}$ of this cell is greater than or equal to the resistance $R_{S.EL}$ of the shunt element $E_{S.EL}$ of the electroluminescent element $E_{EL}$ of this same cell.

Preferably, $R_{S.PC}/R_{S.EL}\geqq 2$, and, better still, $R_{S.PC}/R_{S.EL}\geqq 3$.

Preferably, the panel according to the invention includes, within each cell, a conductive element at each interface between at least one electroluminescent layer and the photoconductive layer in order to electrically connect in series the corresponding electroluminescent and photoconductive elements, and the conductive elements of various cells are electrically isolated from one another.

Preferably, the conductive elements between the same electroluminescent layer and the same photoconductive layer form one and the same conductive layer, which is obviously discontinuous so that the conductive elements of the various cells are electrically isolated from one another; in the case of a panel of the type described in document U.S. Pat. No. 4,035,774, already mentioned, which has two electroluminescent layers, there are therefore two conductive interface layers.

In the most frequent case of a panel with a single electroluminescent layer, each shunt element of the electroluminescent element is connected to the same electrode of the front array and to the same conductive element of the intermediate layer as the electroluminescent element $E_{EL}$ that it shunts; if appropriate each shunt element of the photoconductive element is connected to the same electrode of the rear array and to the same conductive element of the intermediate layer as the photoconductive element $E_{PC}$ that it shunts; the term "shunt element" is understood to mean any shunting means. Several examples will be given later.

Advantageously, the panel according to the invention includes means for driving the cells in order to display images, said means being designed to implement a procedure in which, successively for each row of cells of the panel, a selective address phase, intended to turn on the cells to be turned on in this row, is followed by a non-selective sustain phase, designed to keep the cells of this row in the state in which they had been put or left during the preceding address phase.

Other features and advantages of the invention will become apparent in the description of a preferred embodiment given by way of non-limiting example and with reference to the appended drawings, in which:

FIG. 1 is a sectional diagram of a cell of an electroluminescent panel with a photoconductive layer of the prior art;

FIG. 2 illustrates the equivalent circuit diagram of the cell of FIG. 1;

Figure 3:
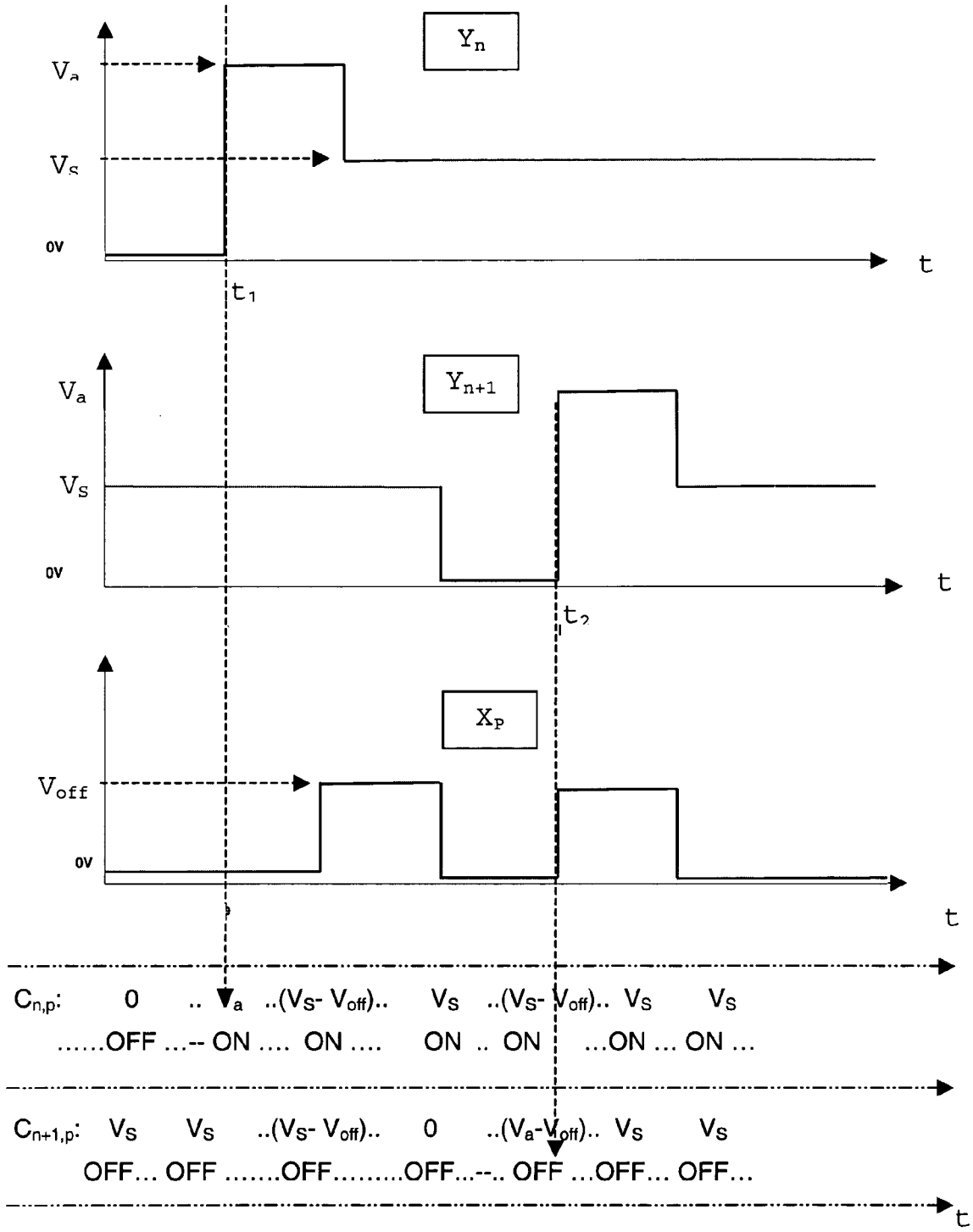
Figure 4:
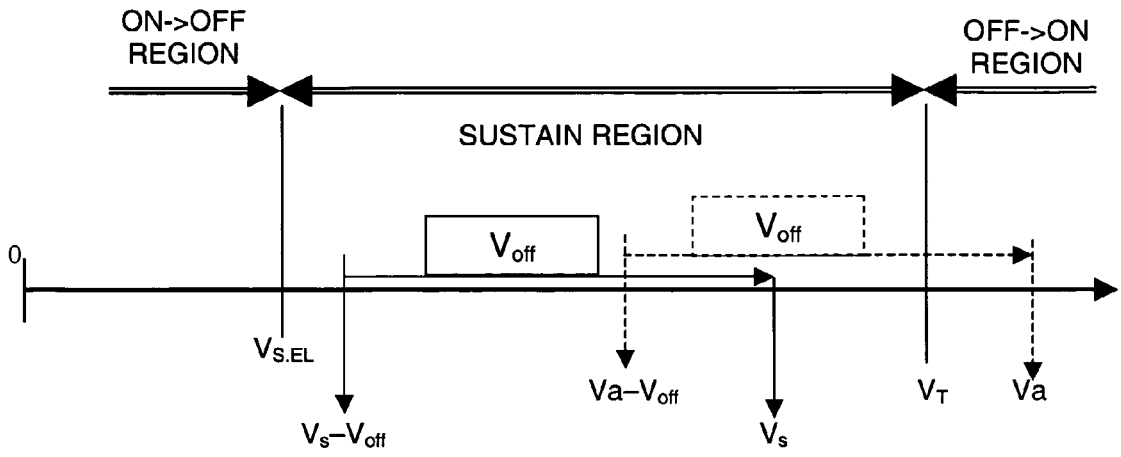
Figure 5:
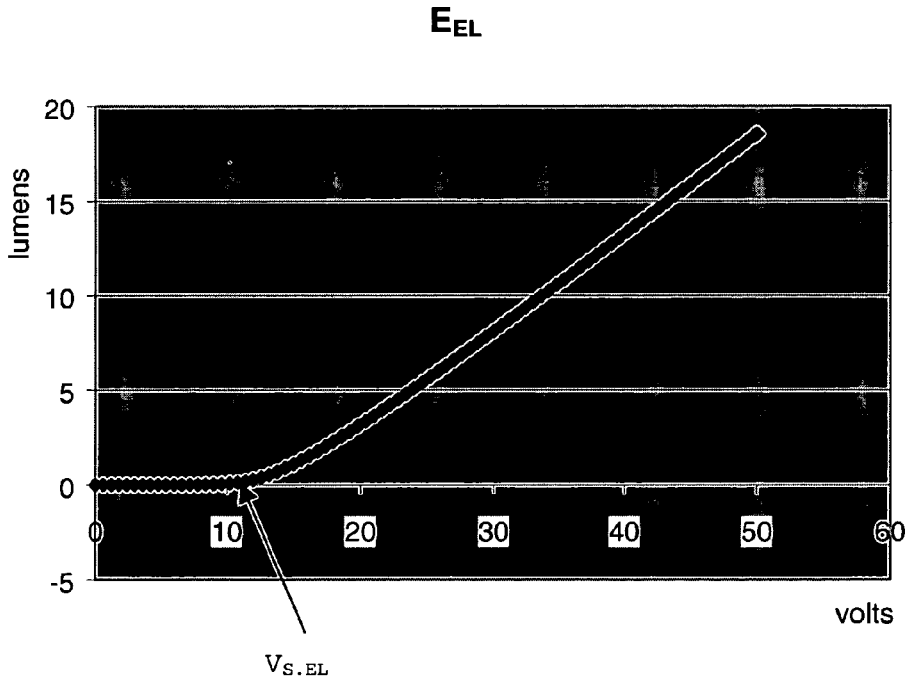
Figure 6:
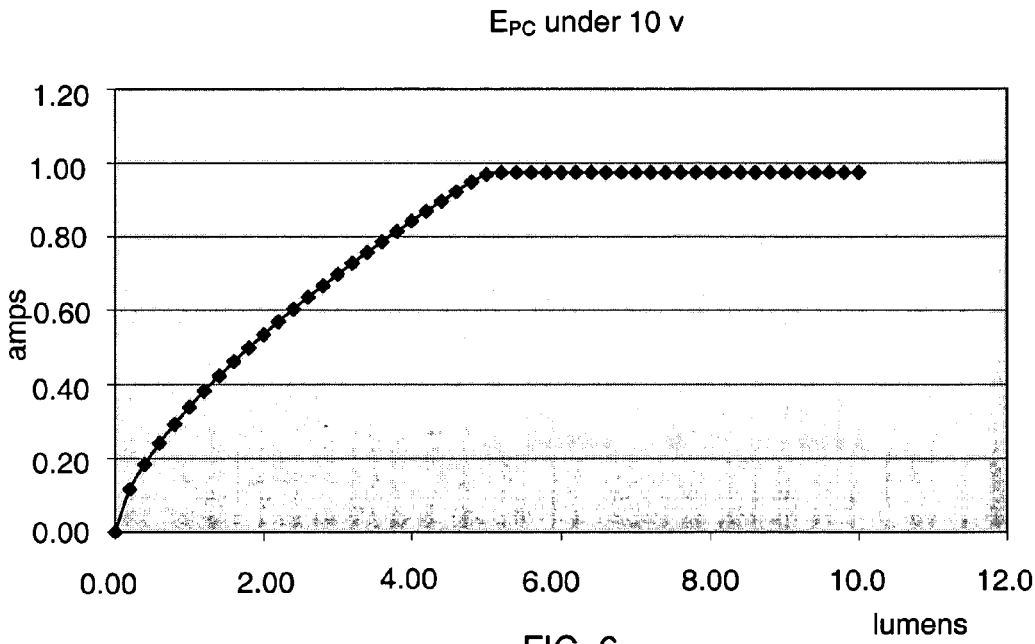
Figure 7:
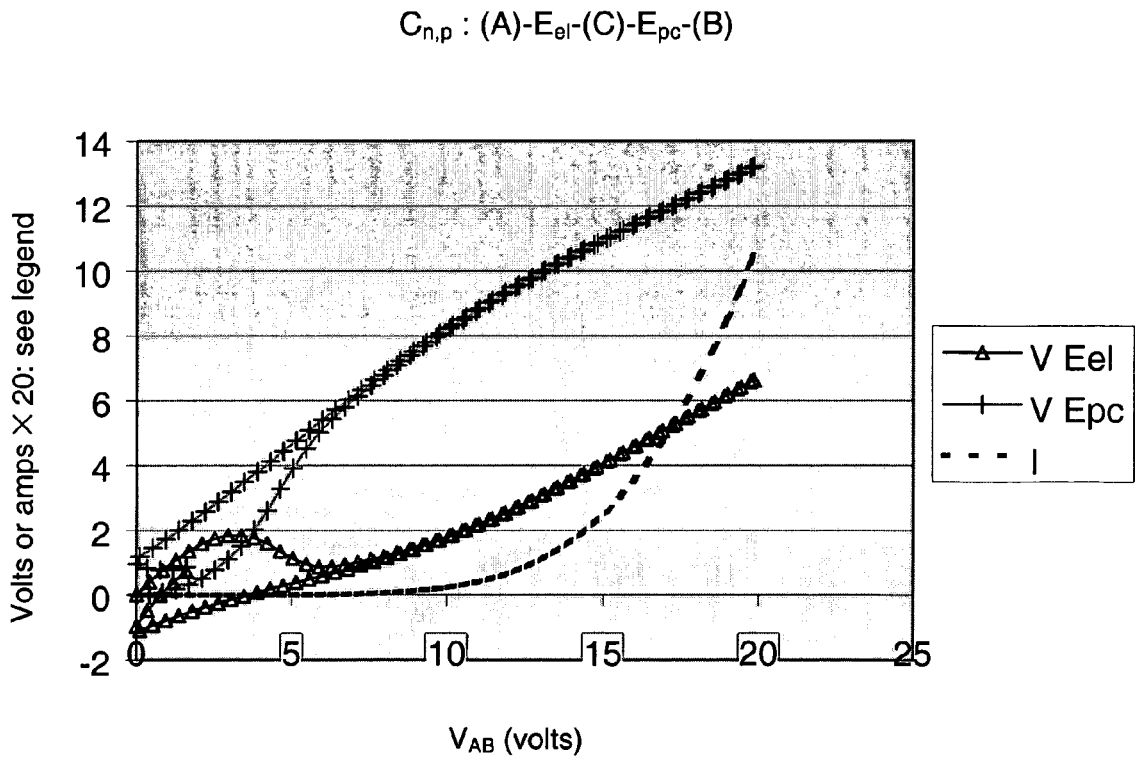
Figure 8:
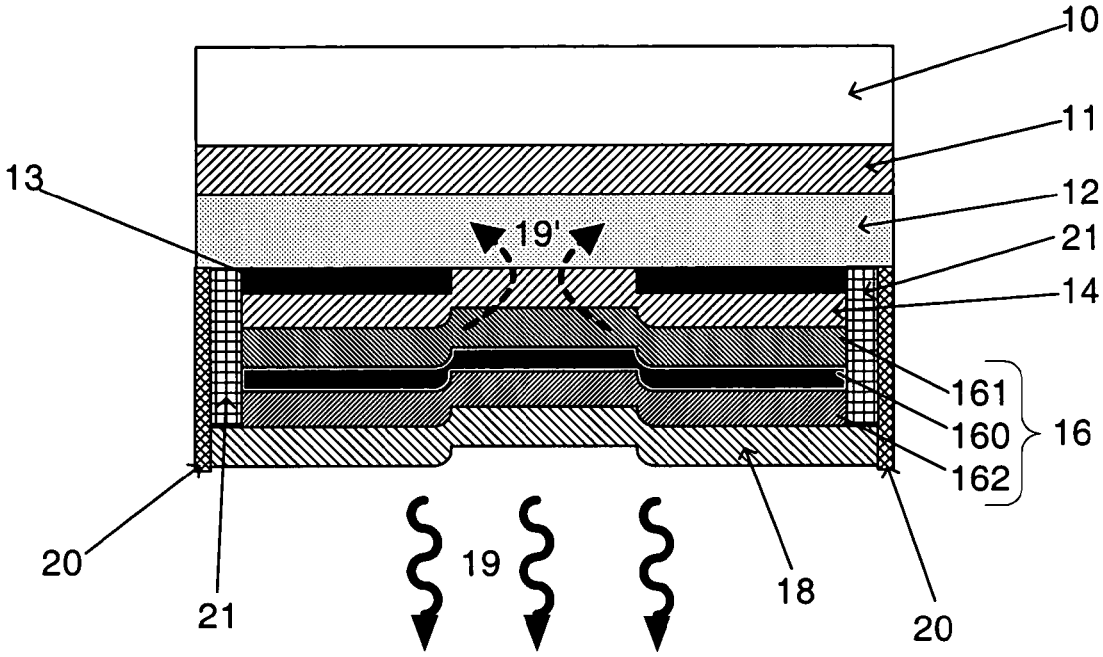
Figure 9:
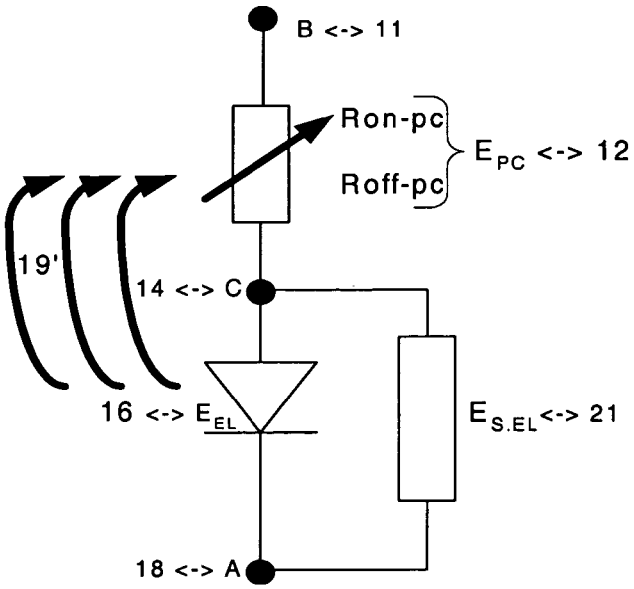
Figure 10:
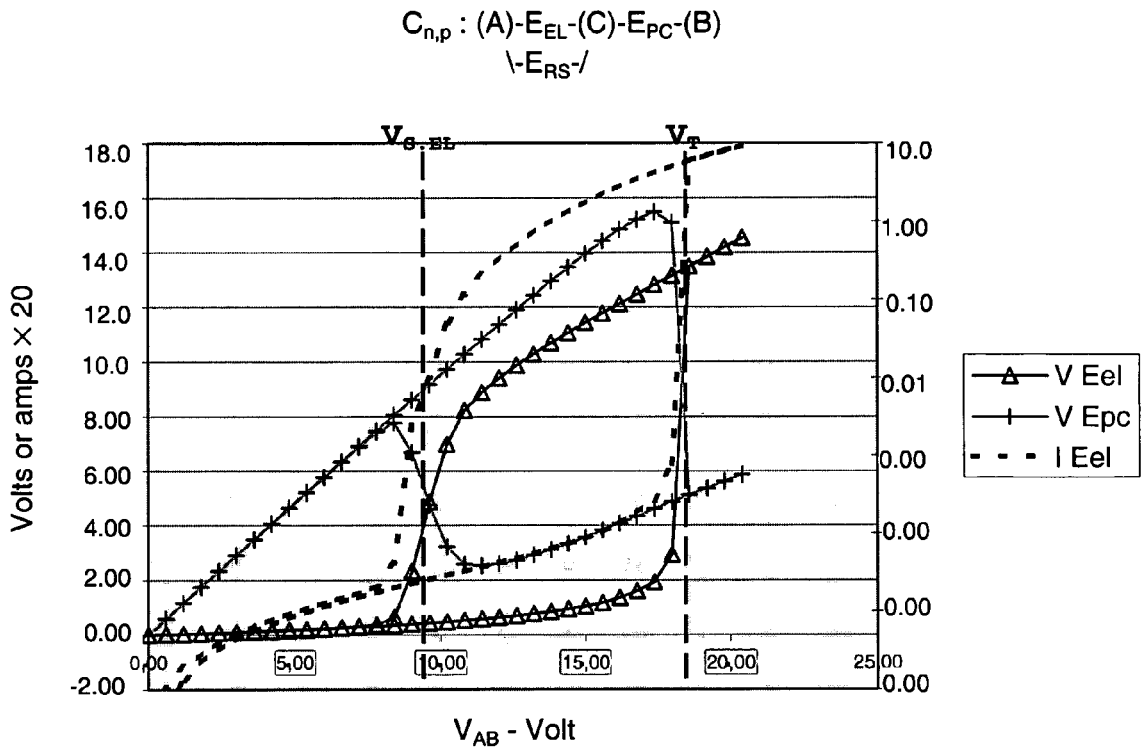
Figure 15:
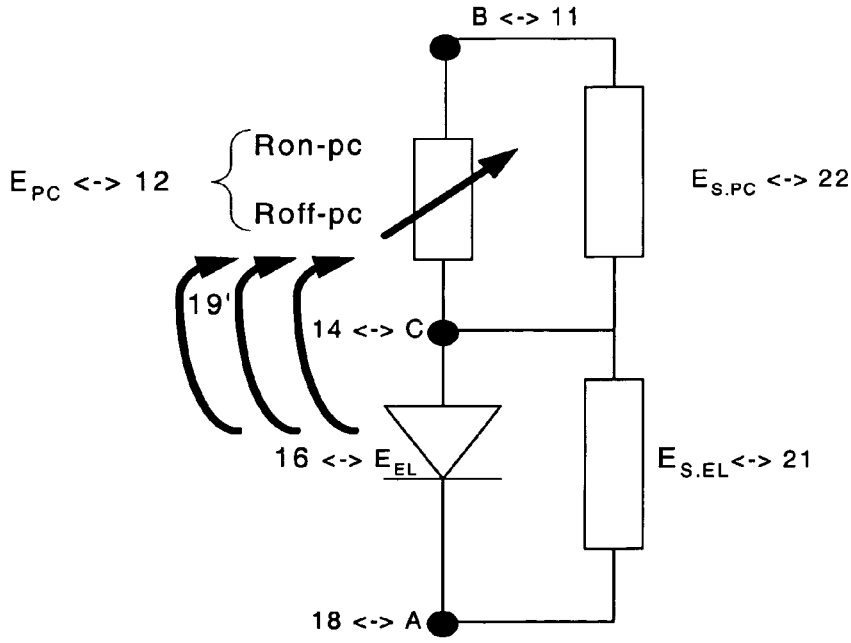
Figure 11:
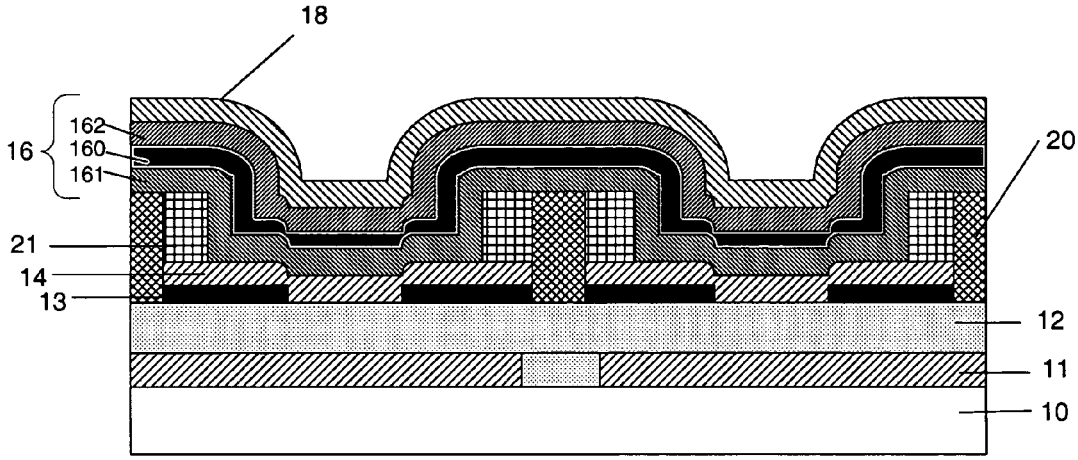
Figure 12:
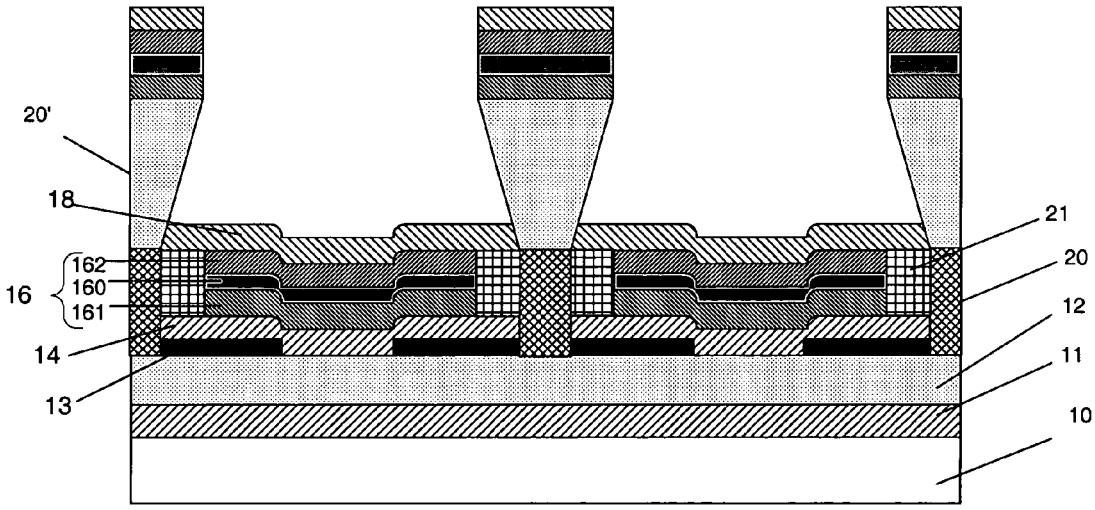
Figure 13:
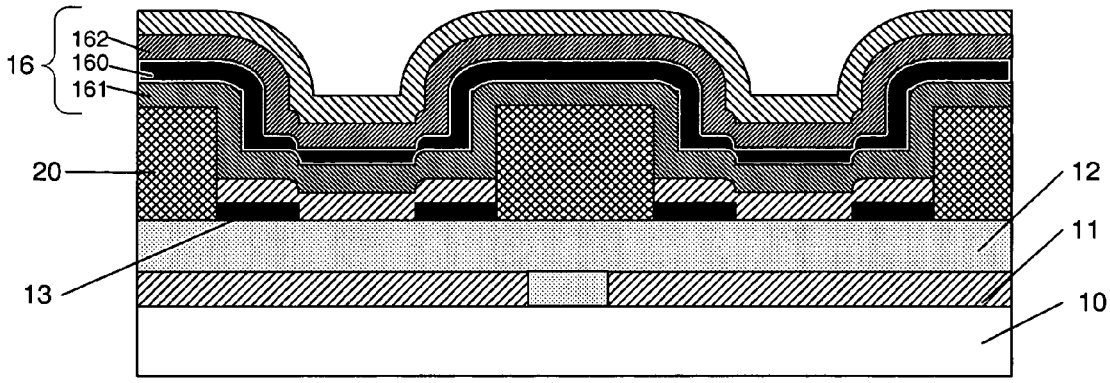
Figure 14:
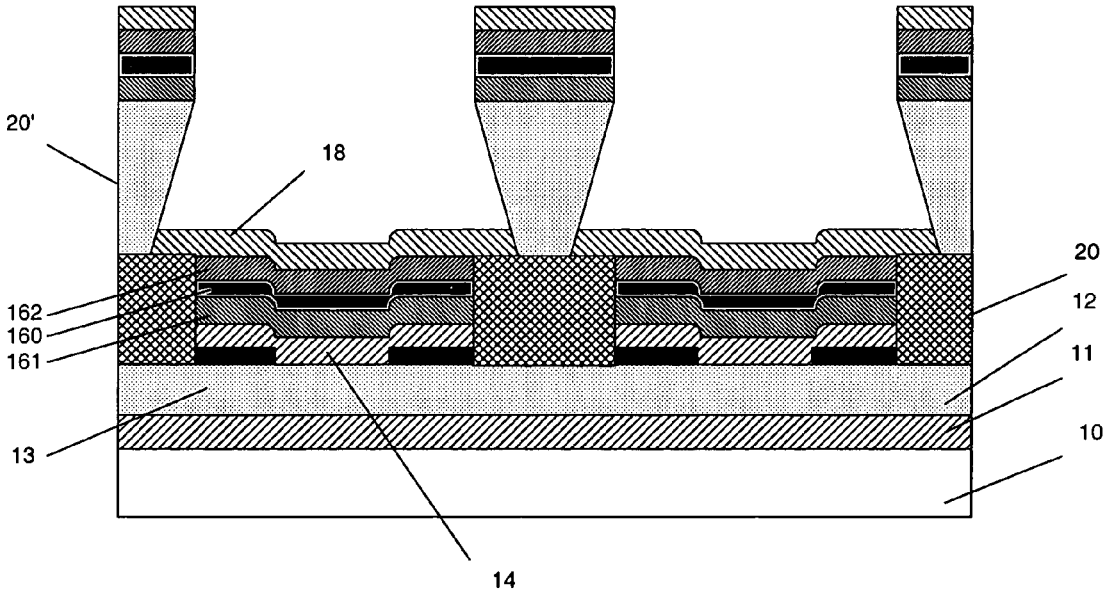

FIG. 3 gives three timing diagrams of the voltages applied to two row electrodes and one column electrode of an electroluminescent matrix panel with memory effect when a conventional panel drive procedure designed to take advantage of the memory effect of the cells of this panel is used;

FIG. 4 illustrates the positioning of the various voltages applied to the electrodes of a panel during application of a drive procedure shown in FIG. 3;

FIGS. 5 and 6 show typical characteristics of an electroluminescent element $E_{EL}$ and of a photoconductive element $E_{PC}$, respectively, of a cell of a panel as shown in FIGS. 1 and 2;

FIG. 7 illustrates, according to the prior art, the distribution of the voltages $V_{E\text{-}el}$ and $V_{E\text{-}pc}$, respectively, across the terminals of the electroluminescent element $E_{EL}$ and of the photoconductive element $E_{PC}$ of a cell of a panel as shown in FIGS. 1 and 2 when a cycle consisting of an increasing voltage (from 0 to 20 V) and then a decreasing voltage (from 20 to 0 V) is applied to the terminals A, B of this cell; this figure also illustrates the variation in the intensity of the current flowing through this cell;

FIG. 8 is a sectional diagram of a cell of an electroluminescent panel with a photoconductive layer in one embodiment of the invention;

FIG. 9 illustrates the equivalent circuit diagram of the cell of FIG. 8;

FIG. 10 illustrates, according to the invention, the distribution of the voltages $V_{E\text{-}el}$ and $V_{E\text{-}pc}$ across the terminals of the electroluminescent element $E_{EL}$ and of the photoconductive element $E_{PC}$, respectively, of a cell of a panel as shown in FIGS. 8 and 9 when a cycle consisting of an increasing voltage (from 0 to 20 V) and then a decreasing voltage (from 20 to 0 V) is applied to the terminals A, B of this cell; this figure also illustrates the variation in the intensity of the current flowing through this cell;

FIGS. 11 and 12 are sections through a first embodiment of a panel according to the invention, in the direction of the row electrodes and in the direction of the column electrodes respectively, these being intended to illustrate a process for fabricating this panel;

FIGS. 13 and 14 are sections through a second embodiment of a panel according to the invention, in the direction of the row electrodes and in the direction of the column electrodes respectively, these being intended to illustrate an alternative form of the process for fabricating this panel illustrated in FIGS. 11 and 12; and FIG. 15 illustrates the equivalent circuit diagram of a cell in another advantageous embodiment of the invention.

The figures showing timing diagrams have not been drawn to scale so as to better reveal certain details that would not be clearly apparent if the proportions had been respected.

To simplify the description and to bring out the differences and advantages that the invention has compared with the prior art, identical references will be used for elements fulfilling the same functions.

A panel in a general embodiment of the invention, that is to say one having shunt elements only for the electroluminescent elements, will now be described; a process for fabricating this panel will also be described.

Referring to FIG. 8, each cell of the panel according to the invention comprises, apart from the elements of the panel already described with reference to FIG. 1, which in this case bear the same references:

barrier ribs 20 surrounding the electroluminescent layer region 16 and the intermediate electrode layer region 14 of this cell, the base of which rests on the photoconductive layer 12 and the top of which reaches at least to the height of the transparent front electrode layer 18; and a shunt layer 21 applied to the sides of these barrier ribs so as to bring the photoconductive layer 12 into electrical contact with the transparent electrode of the layer 18; this shunt layer 21 forms the shunt element $E_{S.EL}$ according to the invention; the resistance $R_{S.EL}$ of this shunt element $E_{S.EL}$ is proportional to the width of the layer 21 (which extends along the height direction of the barrier ribs) and inversely proportional to its thickness; the dimensions of this shunt layer, especially its thickness, and the material of this shunt layer 21 are chosen so that, within each cell, the resistance $R_{S.EL}$ of this shunt element $E_{S.EL}$ that it forms is:

on the one hand, less than or equal to the resistance $R_{OFF-PC}$ of the photoconductive element $E_{PC}$ corresponding to the electroluminescent layer region 16 of this cell, when it is not in the excited state; and on the other hand, less than the resistance $R_{OFF-EL}$ of the electroluminescent element $E_{EL}$ that it shunts, corresponding to the photoconductive layer region 12 of this cell, when it is not in the excited state.

Finally, the material of this shunt layer 21 is not photoconductive so that the resistance of the corresponding shunt elements does not depend on the illumination.

The barrier ribs 20 therefore form a two-dimensional network for defining the cells of the panel; the dimensions of these barrier ribs, especially their height, and the material of these barrier ribs are chosen so that, within each cell, the electrical resistance of these barrier ribs, measured between their base and their top, is substantially greater than that $R_{S.EL}$ of the shunt element $E_{S.EL}$ of this cell; thus, these barrier ribs electrically isolate the cells of the panel from one another; thus:

the shunt elements $E_{S.EL}$ are isolated from one another; and the intermediate electrode layer regions 14, specific to each cell, are electrically isolated from one another so that the electrical potential at the common point between the electroluminescent element $E_{EL}$ and the photoconductive element $E_{PC}$ of this cell is floating.

According to an alternative embodiment of the invention (not shown), the shunt layer has discontinuities around the perimeter of the barrier ribs of a cell so that, for example, only the barrier ribs on one side of each cell are covered with this shunt layer; however, it is of course essential for this shunt layer 21 to bring the photoconductive layer 12 into electrical contact with the transparent electrode of the layer 18.

In an alternative embodiment (not shown), this electrical contact may be provided indirectly by means of the electrodes of the intermediate layer 14.

Referring to FIG. 9, each cell of the panel may be represented by the following elements:

an electroluminescent element $E_{EL}$ surrounding an electroluminescent layer region 16;

in series with the electroluminescent element $E_{EL}$, a photoconductive element $E_{PC}$ enclosing a photoconductive layer region 12 facing this same electroluminescent layer region 16; and in parallel with the electroluminescent element $E_{EL}$, a shunt element $E_{S.EL}$ formed by the shunt layer 21 of this cell.

On the basis of the typical electrical characteristics described above with reference to FIGS. 5 and 6 of the electroluminescent element $E_{EL}$ and of the photoconductive element $E_{PC}$, and by choosing $R_{S.EL}$=25 kΩ, approximately equal to ¼ $R_{OFF-PC}$ (with $R_{OFF-PC}$=100 kΩ approximately), the overall current-voltage characteristics of this cell according to the invention are examined: see FIG. 10, which illustrates, when a voltage increasing from 0 to 20 V and then decreasing from 20 to 0 V is applied across the terminals A, B of a cell:

the voltage $V_{E-el}$ across the terminals A, C of the electroluminescent element $E_{EL}$ of the cell and of the shunt element $E_{S.EL}$;

the voltage $V_{E-pc}$ across the terminals C, B of the photoconductive element $E_{PC}$ of the cell; and the intensity I of the current flowing through the electroluminescent element $E_{EL}$.

It has been found that, during a cycle in which the voltage increases up to ignition (high intensity) and then decreases down to extinction, the variation in the intensity I of the current in this cell exhibits substantial hysteresis, thanks to the addition of the shunt element $E_{S.EL}$ according to the invention.

It is therefore possible to use, for driving the cells of the panel and for displaying images, a procedure in which, successively in the case of each row of the panel, a selective address phase, designed to turn on the cells to be turned on in this row, is followed by a non-selective sustain phase, designed to keep the cells of this row in the state in which they were put or left during the preceding address phase.

By using the previous definitions of Va, $V_S$, $V_{off}$ with reference to FIGS. 3 and 4, in order to employ this drive procedure:

it is sufficient to choose Va (cell ignition voltage) greater than or equal to the voltage $V_T$; the voltage $V_T$ is that which, applied across the terminals of an extinguished cell in the OFF state, causes it to ignite and to switch to the ON state; the value of $V_T$ is given in FIG. 10; and it is sufficient to choose $V_S$ (cell sustain voltage) and $V_{off}$ such that the value ($V_S$–$V_{off}$) is greater than or equal to the voltage $V_{S.EL}$; the voltage $V_{S.EL}$ is that which, applied across the terminals of an electroluminescent element $E_{EL}$, causes its ignition ($V>V_{S.EL}$) or its extinction ($V<V_{S.EL}$); the value of $V_{S.EL}$ is also given in FIG. 10.

As explained above, $V_T$ may furthermore be given by $V_T=(1+R_{OFF-PC}/R_{S.EL})V_{S.EL}$.

Unlike the prior art, it has been found that there is a sustain region (see FIGS. 4 and 10) of voltage values in which, with the cell of the panel having been turned on beforehand, the latter remains turned on; thanks to the shunt element $E_{S.EL}$ specific to the invention, the memory effect described above is therefore obtained for all the cells of the panel.

To fabricate the electroluminescent display panels according to the invention, layer deposition and etching methods conventional to those skilled in the art are used for this type of panel; one process for fabricating such a panel will now be described with reference to FIGS. 11 and 12 which are cross sections through the panel in the direction of the row electrodes and in the direction of the column electrodes respectively.

A uniform layer of aluminum is deposited, by sputtering or by vacuum evaporation (PVD), on a substrate 10 formed for example by a glass plate, and then the layer obtained is etched so as to form an array of parallel electrodes or column electrodes $X_p$, $X_{p+1}$: thus, the opaque rear electrode layer 11 is obtained.

Next, deposited on this column electrode layer 11 is a uniform layer of photoconductive material 12, for example amorphous silicon, by plasma-enhanced chemical vapor deposition (PECVD), or an organic photoconductive material by chemical vapor deposition (CVD) or by spin-coating.

Next, the optical coupling layer 13 is applied, this layer comprising, for each future electroluminescent cell Cn,p, a coupling element 25 formed from an aluminum opaque layer portion pierced at its center by an aperture 26 designed to let the light through toward the photoconductive layer 12. This is carried out by depositing a uniform layer of aluminum 25 followed by etching of the optical coupling apertures 26 positioned at the center of the future cells of the panel and the etching of the regions defining the future barrier ribs 20 that are intended to partition the panel into cells.

Next, a thin conductive layer 14 of mixed indium tin oxide (ITO), intended to form intermediate connection electrodes between the photoconductive elements of the photoconductive layer 12 and the electroluminescent elements of this cell, is applied by vacuum sputtering. This layer is then etched, again in order to define the regions in which the barrier ribs 20 will be placed.

The two-dimensional network of barrier ribs 20 intended to partition the panel into electroluminescent cells $C_{n,p}$ and to electrically isolate the shunt elements $E_{S.EL}$ of each cell is then formed. For this purpose, a uniform layer of organic barrier rib resin is firstly deposited by spin-coating and then this layer is etched so as to form the two-dimensional network of barrier ribs 20.

Next, the material used for the "shunting" according to the invention is deposited as a full layer homogeneously over the entire active surface of the panel; this layer matches the reliefs that the surface of the panel has at this step of the process; the shunt elements $E_{S.EL}$ according to the invention are then obtained by full-wafer anisotropic etching so as to leave a shunting layer of thickness equal to the initial thickness of the coating only on the walls of the barrier ribs 20; referring to the figure, the etching is therefore carried out only in the vertical direction and removes only the horizontal parts of the shunting layer; the shunting layer 21 and the shunt elements $E_{S.EL}$ according to the invention are therefore obtained for each cell; for example, the "shunting" material may be titanium nitride (TiN) obtained by chemical vapor deposition (CVD); the anisotropic etching may be carried out in a "high density" plasma etching chamber using a suitable chemistry known per se. For a 500×500 $\mu m^2$ cell, it is necessary to have a thickness of between 2 nm and 100 nm of titanium nitride (TiN—a material whose resistivity can be adjusted from $2\times10^{-4}$ Ω.cm to $10^{-2}$ Ω.cm) in order to obtain a shunt resistance $R_{S.EL}$ of around 5 kΩ, capable of providing the operation in bistable mode with memory effect according to the invention.

Referring to FIG. 12, an array of separators 20' perpendicular to the column electrodes $X_p$, $X_{p+1}$ is then mounted, on the barrier ribs 20, perpendicular to the column electrodes $X_p$, $X_{p+1}$ and between the future cells. For this purpose, a uniform layer of an organic barrier rib resin is firstly deposited by spin-coating and then this layer is etched so as to form the array of separators 20'; the height of the separators, that is to say the thickness of the deposited layer, must be substantially greater than the thickness of the layers yet to be deposited in the subsequent phases of the process, as illustrated in FIG. 12.

Next, the organic layers 161, 160, 162 intended to form the electroluminescent elements $E_{EL}$ of the electroluminescent layer 16 are deposited between the barrier ribs 20 coated with the shunt layer 21 according to the invention; these organic layers 161, 160, 162 are known per se and will not be described here in detail. Other variants may be envisioned without departing from the invention, especially the use of mineral electroluminescent materials.

Next, the transparent conductive layer 18 is deposited between the heightened barrier ribs 20' perpendicular to the column electrodes $X_p$, $X_{p+1}$, so as to form rows of electrodes $Y_n$, $Y_{n+1}$; preferably, this layer comprises the cathode and an ITO layer. The deposition conditions must be such that the edge of the shunt elements $E_{S.EL}$ of each cell is covered by this transparent layer 18. An image display panel according to the invention is thus obtained.

A variant of the process for fabricating the panel according to the invention will now be described with reference to FIGS. 13 and 14. The process remains the same as the process described above, except that the surface layer of the sides of the barrier ribs 20 will be used as shunt element $E_{S.EL}$ according to the invention instead of the shunt layer 21. For this purpose, the barrier ribs will be doped on the surface in order to make its surface layer more conductive; this process is advantageous as it dispenses with depositing a specific shunt layer; given the usual dimensions of the barrier ribs (of the order of 1 μm in thickness for a width of 40 μm), the leakage generated by the surface doping of the barrier ribs will be sufficient to obtain the desired shunt effect between the electrodes at the terminals of the electroluminescent elements $E_{EL}$ within each cell; since the conductive doping of the barrier ribs is only superficial, the same electrical isolation as previously between the cells of the panel is maintained.

According to a third embodiment, the shunt function according to the invention is provided by doping the organic electroluminescent multilayer 16 in a manner suitable for creating parallel channels for non-recombinatory transport of charges through this layer.

A person skilled in the art will immediately derive from the detailed description given above and from his general knowledge the elements needed to produce a panel according to a preferred embodiment of the invention, that is to say a panel having shunt elements both at the electroluminescent elements and the photoconductive elements, on the basis of the general description of this embodiment given at the beginning of this document.

The present invention applies to any type of electroluminescent matrix panel, whether using organic electroluminescent materials or inorganic electroluminescent materials.

The invention claimed is:

1. An image display panel comprising a matrix of bi-stable electroluminescent cells that can be either in an "on" state or in an "off" state, comprising;

a front array of electrodes and a rear array of electrodes, the electrodes of the front array crossing the electrodes of the rear array at each bi-stable electroluminescent cell of said matrix of bi-stable electroluminescent cells, wherein each bi-stable electroluminescent cell of said matrix of bi-stable electroluminescent cells comprises at least one electroluminescent element and a photoconductive element that are electrically connected in series having two outermost terminals, one of the outermost terminals being connected to an electrode of said front array and the other one of the outermost terminals being connected to an electrode of said rear array, wherein the at least one electroluminescent element includes at least one electroluminescent layer and the photoconductive element includes a photoconductive layer, means for optical coupling, at each bi-stable electroluminescent cell of said matrix of bi-stable electroluminescent cells, the at least one electroluminescent layer of the at least one electroluminescent element and the photoconductive layer of the photoconductive element, and wherein each bi-stable electroluminescent cell of said matrix of bi-stable electroluminescent cells includes a first shunt element electrically connected in parallel with the at least one electroluminescent element and wherein the shunt element has a resistance which does not depend on illumination.

2. The panel as claimed in claim 1, wherein, when any bi-stable electroluminescent cell of this the image display panel is in an "on" state, the photoconductive element of said bi-stable electroluminescent cell is in an "excited" state and the electroluminescent element of said bi-stable electroluminescent cell is in an "on" state, and when any bi-stable electroluminescent cell of the image display panel is in an "off" state, the photoconductive element of said bi-stable electroluminescent cell is in an "unexcited" state and the electroluminescent element of said bi-stable electroluminescent cell is in an "off" state, and wherein for each bi-stable electroluminescent cell, the resistance of the first shunt element electrically connected in parallel with the at least one electroluminescent element of said bi-stable electroluminescent cell is greater than a resistance of the electroluminescent element when the electroluminescent element is in the "on" state.

3. The panel as claimed in claim 2, wherein, for each bi-stable electroluminescent cell, the resistance of the first shunt element is less than or equal to the resistance of the photoconductive element of said bi-stable electroluminescent cell when the photoconductive element is in the "unexcited" state and is less than a resistance of the at least one electroluminescent element of said electroluminescent cell when the electroluminescent element is in the "off" state.

4. The panel as claimed in claim 3, wherein the resistance of the first shunt element is less than or equal to one half of the resistance of the photoconductive element of said bi-stable electroluminescent cell when the electroluminescent element is in the "unexcited" state.

5. The panel as claimed in claim 1, wherein the image display panel also comprises, for each bi-stable electroluminescent cell, a second shunt element that is electrically connected in parallel with the photoconductive element of said bi-stable electroluminescent cell.

6. The panel as claimed in claim 5, wherein, when any bi-stable electroluminescent cell of the image display panel in an "on" state, the photoconductive element of said bi-stable electroluminescent cell is in an "excited" state and the electroluminescent element of said bi-stable electroluminescent cell is in an "on" state, and when any bi-stable electroluminescent cell of the image display panel is in an "off" state, the photoconductive element of said bi-stable electroluminescent cell is in an "unexcited" state and the electroluminescent element of said bi-stable electroluminescent cell is in an "off" state, and wherein for each bi-stable electroluminescent cell, the resistance of the second shunt element that is electrically connected in parallel with the photoconductive element of said bi-stable electroluminescent cell:

is less than or equal to a resistance of this the photoconductive element when said photoconductive element is in the "unexcited" state; and is greater than or equal to the resistance of the first shunt element that is electrically connected in parallel with the at least one electroluminescent element of said bi-stable electroluminescent cell.

7. The panel as claimed in claim 1, wherein the image display panel includes, within each bi-stable electroluminescent cell, a conductive element at each interface between the at least one electroluminescent layer of said bi-stable electroluminescent cell and the photoconductive layer of said bi-stable electroluminescent cell in order for the at least one electroluminescent element and the photoconductive element to be electrically connected in series and wherein conductive elements that belong to different bi-stable electroluminescent cells of said image display panel are electrically isolated from one another.

8. The panel as claimed in claim 1, the bi-stable electroluminescent cells of which being distributed in rows and columns, wherein said image display panel includes means for driving the bi-stable electroluminescent cells for image display, said means being designed to implement a procedure in which, successively for each row of cells of the panel, a selective address phase, designed to turn on the bi-stable electroluminescent cells to be turned on in said row, is followed by a non-selective sustain phase, designed to keep the bi-stable electroluminescent cells of said row in the state in which said bi-stable electroluminescent cells had been put or left during the preceding address phase.

9. The panel as claimed in claim 1, wherein the at least one electroluminescent layer is organic.

* * * * *